US006168325B1

(12) United States Patent
Nagata

(10) Patent No.: US 6,168,325 B1
(45) **Date of Patent: *Jan. 2, 2001**

(54) PRINTER

(75) Inventor: Atsushi Nagata, Asaka (JP)

(73) Assignee: Fuji Photo Film Co., Ltd., Kanagawa (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/256,306

(22) Filed: Feb. 24, 1999

(30) Foreign Application Priority Data

Feb. 27, 1998 (JP) ..... 10-048189

(51) Int. Cl.[7] ..... B41J 2/315
(52) U.S. Cl. ..... 400/120.01; 396/1; 396/2
(58) Field of Search ..... 400/120.01, 120.02, 400/120.03, 120.04; 396/1, 2

(56) References Cited

U.S. PATENT DOCUMENTS 4,868,410 * 9/1989 Andrews et al. ..... 358/443
5,196,876 * 3/1993 Thayer ..... 396/2
5,500,700 * 3/1996 Massarsky ..... 396/2
5,585,832 * 12/1996 Orimoto et al. ..... 400/120.02 X
5,617,138 * 4/1997 Ito et al. ..... 348/222
5,717,958 * 2/1998 Oka et al. ..... 396/2
5,743,663 * 4/1998 Imai ..... 400/120.4
5,784,651 * 7/1998 Mauchan ..... 396/2
5,913,019 * 7/1998 Attenberg ..... 395/117

FOREIGN PATENT DOCUMENTS 5-161064 6/1993 (JP) ..... H04N 5/265

* cited by examiner

*Primary Examiner*—John S. Hilten
*Assistant Examiner*—Minh Chau
(74) *Attorney, Agent, or Firm*—Sughrue, Mion, Zinn, Macpeak & Seas, PLLC

(57) ABSTRACT

In an electronic picture print system that is activated in response to the deposit of money and provides a printing service in accordance with the control of a user, a printer starts feeding paper upon detection of the deposit of money. While the user is selecting a background frame and taking a picture, the preparations for printing are completed. Therefore, the printing is started immediately in response to a printing instruction, and this reduces the time required for one play.

17 Claims, 6 Drawing Sheets

PRINTER

BACKGROUND OF THE INVENTION

1. Field of the Invention

The present invention relates generally to a printer, and more particularly to a printer suitable for an electronic picture printing system, which is placed in arcades and on the streets and prints a picture showing a user as a main subject onto recording paper for producing a peel-off sticker provided to the user.

2. Description of Related Art

An electronic picture printing system such as an electronic photo booth system disclosed in Japanese Patent Provisional Publication No. 5-161064, which has built-in imaging means and printing means, is well known and is placed in arcades and on the streets. The electronic picture printing system takes a picture with the imaging means after a user deposits money into the electronic picture printing system and selects a background frame. Then, paper starts feeding to the printing means after the user presses a printing instruction button. The picture is printed on the paper upon completion of the feeding, and the printed paper is ejected upon completion of the printing.

In the electronic picture printing system in arcades, the reduction of the time required for one use immediately increases the profit. For this reason, there is a desire to reduce the time for printing on the printer in the electronic picture printing system.

SUMMARY OF THE INVENTION

The present invention has been developed in view of the above-described circumstances, and has as its object the provision of a printer that reduces the time for printing.

To achieve the above-mentioned object, the present invention is directed to a printer comprising: a paper storage part for storing paper; a paper feeder for feeding the paper to a printing part from the paper storage part; a printing data receiving part for receiving printing data representing an image to be printed; the printing part for printing the image represented by the printing data on the paper fed by the paper feeder; and a controller for directing, upon receiving a preparatory signal, the paper feeder to prepare for the printing by transporting the paper to a printing preparation position before the receiving of the printing data is completed.

Conventionally, the paper starts feeding after the transfer of the printing data is completed. According to the present invention, the paper starts feeding upon receiving the preparatory signal before the transfer of the printing data is completed. Specifically, the controller directs the paper feeder to prepare for printing in response to the input of the preparatory signal so that the paper can start feeding before the input of the printing data or during the input of the printing data. As soon as the input of the printing data is completed, the printing part starts printing. This reduces the printing time.

The present invention is directed to the printer further comprising: a mechanism for shifting the printing part between a standby state, and a retracted state where the printing is impossible; wherein the controller directs, upon receiving the preparatory signal, the shifting mechanism to prepare for the printing by shifting the printing part to the standby state before the receiving of the printing data is completed.

According to the present invention, the printing part shifts to the standby state at the early stage to prepare for printing.

Since the printing part prepares for printing before or during the input of the printing data, the printing time is reduced.

For example, the printing part comprises a thermal head for selectively heating the paper in a pattern corresponding to the image to be printed; and the printing preparation position of the paper and the standby state of the printing part are a position of the paper and a state of the printing part, respectively, ready for the thermal head to heat the paper.

It is preferable that if a predetermined time has elapsed without a printing start instruction in the state where the paper is set at the printing preparation position, the controller directs the paper feeder to cancel the preparation by restoring the paper from the printing preparation position to a state prior to the receiving of the preparatory signal.

This is particularly advantageous if roll paper (continuous paper) is used. If a precut sheet of paper is used, a complicated mechanism is required to restore the sheet of paper. In this case, it is preferable that the paper feeder comprises a pinch roller and a capstan roller for pinching the paper to feed; and if a predetermined time has elapsed without a printing start instruction in a state where the paper is set at the printing preparation position, the controller directs the paper feeder to make the pinch roller and the capstan roller release the paper.

To achieve the above-mentioned object, the present invention is directed to a printer comprising: a paper storage part for storing heat-sensitive paper comprising a base and a color producing layer formed on the base; a paper feeder for feeding the paper to a printing part from the paper storage part; a printing data receiving part for receiving printing data representing an image to be printed; the printing part for printing the image represented by the printing data on the paper fed by the paper feeder, the printing part comprising a thermal head for selectively heating the paper in a pattern corresponding to the image to be printed such that the color producing layer produces a color; a fixing lamp for throwing a light of a predetermined wavelength onto the paper to stop an action of the color producing layer after the thermal head heats and activates the color producing layer; and a controller for pre-lighting the fixing lamp upon receiving a preparatory signal before the receiving of the printing data is completed.

According to the present invention, the fixing lamp is lighted in response to the input of the preparatory signal, and the fixing lamp is lighted before or during the input of the printing data. Conventionally, the fixing lamp is lighted after the input of the printing data is completed, and the printing stops until the intensity of light emitted from the fixing lamp becomes constant. The present invention can stabilize the intensity of light emitted from the fixing lamp quickly and shorten the suspension period. This reduces the printing time as a whole.

The intensity of light emitted from the fixing lamp is closely related to the temperature around the fixing lamp. The higher the temperature is, the higher the intensity is. At a high temperature, the intensity is stabilized at a prescribed value. Accordingly, the printer preferably further comprises a temperature measuring part for measuring a temperature around the fixing lamp; wherein the controller stops the pre-lighting of the fixing lamp if the temperature measured by the temperature measuring part is higher than a predetermined temperature.

The printer of the present invention is preferably used as a printing means for a system that is activated in response to the deposit of money and provides a printing service in accordance with the control of the user. For example, the present invention is used as a printing means for the electronic picture printing system, which comprises a money receiving part for receiving and counting the deposited money corresponding to the charge, an imaging means for imaging a subject in accordance with an instruction from a control part when the money receiving part receives the deposited money amounting to the charge, and the printing means for printing the image including the subject captured by the imaging means. In this case, it is possible to reduce the time from the deposit of money until the completion of printing.

To achieve the above-mentioned object, the present invention is directed to the printer further comprising a money receiver for receiving deposited money, the money receiver counting the deposited money, the money receiver outputting the preparatory signal to the controller when the deposited money amounts to a predetermined charge.

The printer is preferably constructed in such a way that if the money receiver is directed to refund the deposited money, at least one of the following sequences is performed in order to cancel the preparation for printing: 1) the paper is restored from the printing preparation position, 2) the paper is released from the pinch roller and the capstan roller, and 3) the fixing lamp is turned off.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENT

This invention will be described in further detail by way of example with reference to the accompanying drawings.

Figure 1:
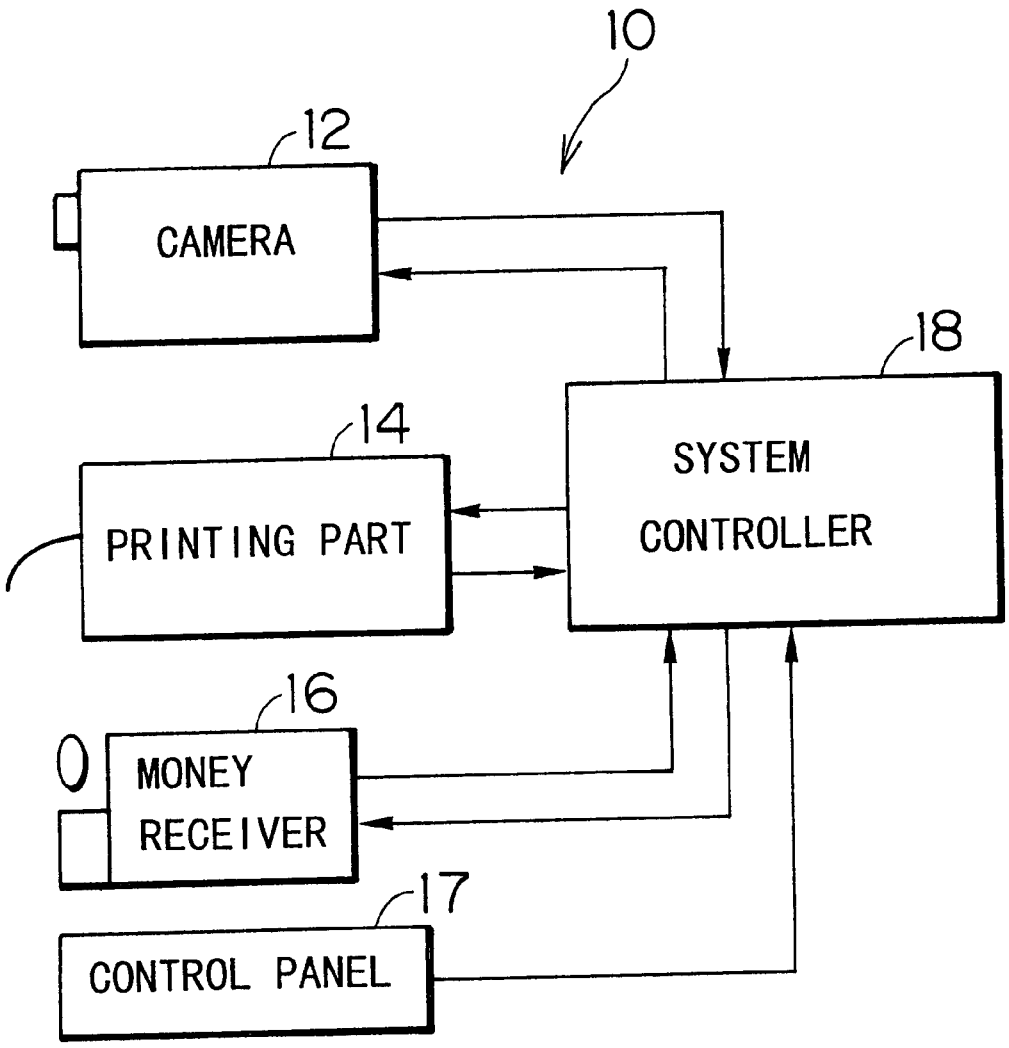
FIG. 1 is a block diagram illustrating the structure of an electronic picture print system according to the first embodiment of the present invention.

FIG. 1 is a block diagram illustrating the structure of an electronic picture print system according to the first embodiment of the present invention. As shown in FIG. 1, the system 10 comprises a camera 12, a printing part 14, a money receiver 16, a control panel 17, and a system controller 18 that supervises these components.

The camera 12 has a taking lens, an imaging device such as a charge-coupled device (CCD), a signal processing part, etc., and converts a captured subject image into image data. Specifically, the subject image is formed on a light-receiving surface of the CCD through the taking lens, and it is photoelectrically converted into image signals, which are sequentially read from the CCD. A CDS circuit samples and holds the image signal for each pixel. A gain control amplifier amplifies the image signals. An A/D converter converts the image signals into dot-sequential R, G and B digital signals. The digital signals are sent to a digital signal processing circuit, which performs predetermined processing such as generation of a brightness signal, generation of a color difference signal and calculation of a photometry value. The image data representing the subject image is acquired by the camera 12 in the above-mentioned manner, and it is sent to the system controller 18.

The system controller 18 comprises an image memory and an image composing circuit. The system controller 18 combines the image data, which is sent from the camera 12, with a frame image, which is selected by a user among a plurality of frame images representing background images, thus generating composite picture data. The system controller 18 sends the composite picture data, in which the subject is put on the background frame, to the printing part 14 and controls the printing part 14.

Although the detailed structure of the printing part 14 will be described later, the printing part 14 operates in a thermoautochrome (TA) method. The printing part 14 comprises a thermal head and color fixing lamps for printing the picture on special paper, which is provided with a thermal color developing function.

The money receiver 16 receives deposited money, which includes paper money, coins, tokens, prepaid cards, charge cards, credit cards, debit cards, etc., corresponding to a predetermined charge. The money receiver 16 can count the deposited money, and can refund the deposited money if the user so directs, prior to the printing.

The user operates the control panel 17 to enter a variety of commands regarding the selection of the background frame, the cancellation/confirmation of the captured image, and the instruction to start printing.

Figure 2:
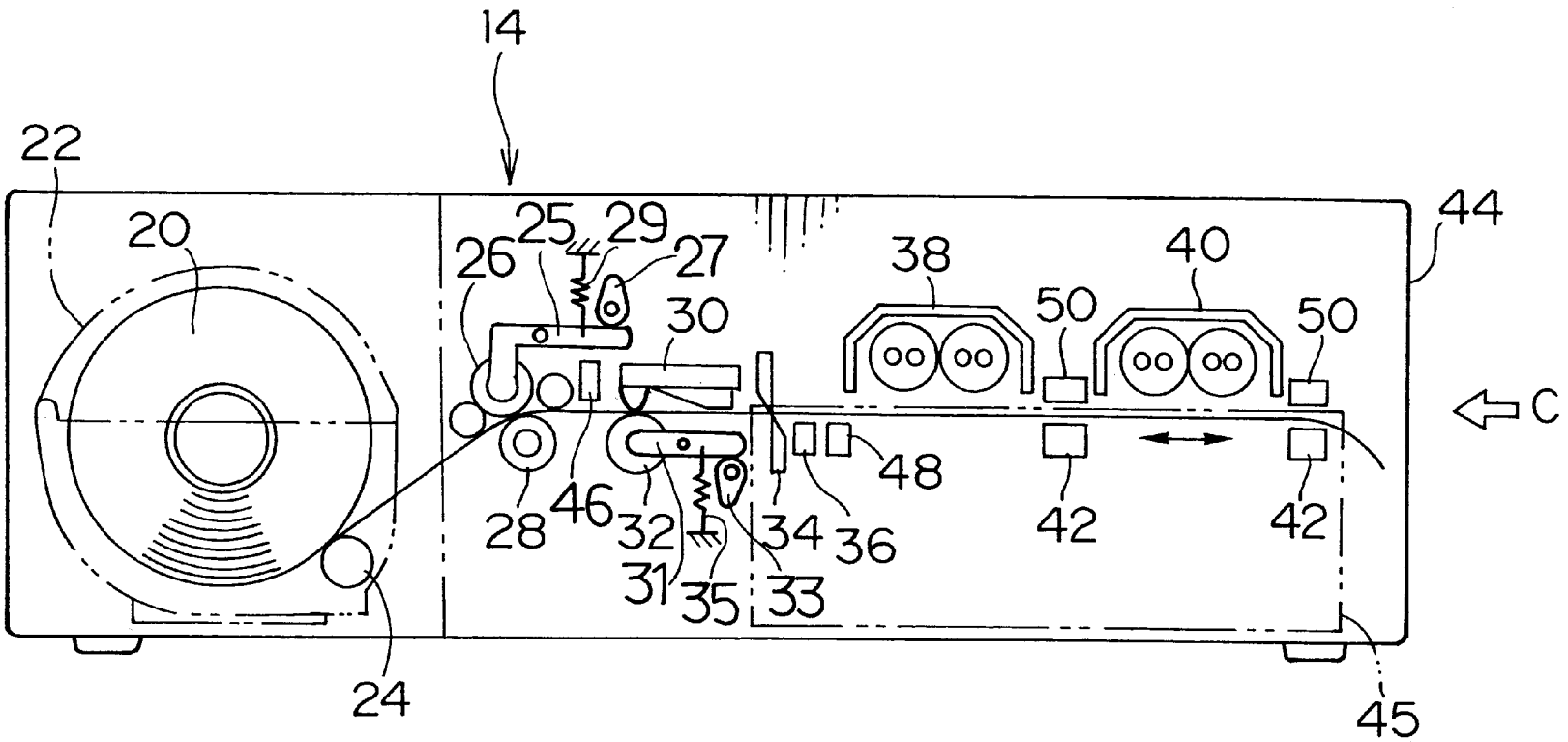
FIG. 2 is a front view illustrating the structure of a printing part in FIG. 1.
Figure 3:
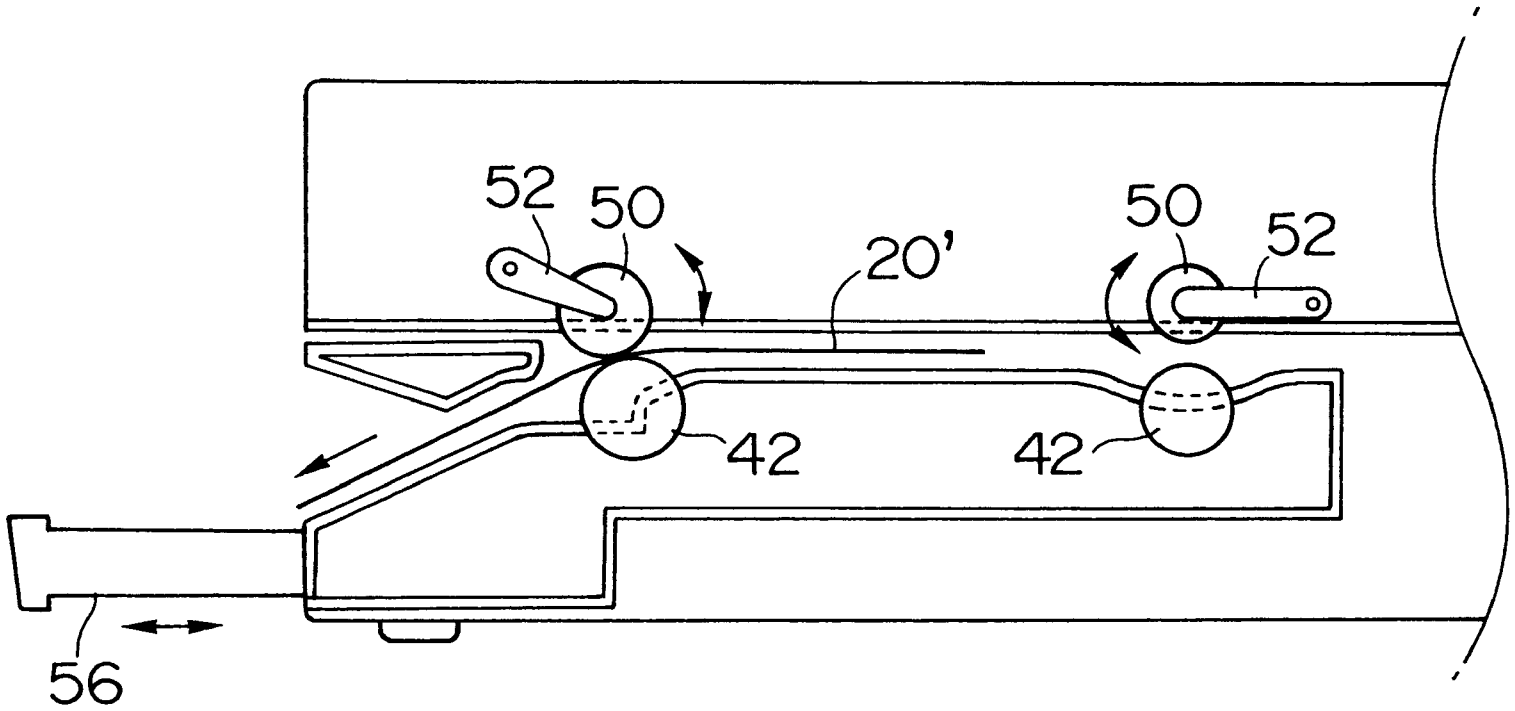
FIG. 3 is a side view illustrating the structure of the printing part taken from an arrow 3 of FIG. 2.

FIG. 2 is a front view illustrating the structure of the printing part 14, which is used in the electronic picture printing system according to the present invention. FIG. 3 is a side view illustrating the structure of the printing part 14 taken from an arrow 3 of FIG. 2.

As described above, the printing part 14 is a digital color printer that operates in the TA method, and it comprises a roll paper storage part 22, which stores a roll of paper 20, a feed roller 24, a pinch roller 26, a capstan roller 28, the thermal head 30, a platen roller 32, a cutter part 34, a photo-sensor 36, a magenta (M) color fixing lamp 38, a yellow (Y) color fixing lamp 40, and paper ejecting rollers 42. These components are contained in a substantially rectangular-parallelepiped casing 44. Reference numeral 45 is a paper exit tray part.

The paper 20 is continuous paper for producing peel-off stickers, and it is rolled up so that a side thereof on, which the pictures are, printed faces to the inside. The paper 20 comprises sticker paper and backing paper on which the sticker paper is attached. Pictures are printed on the sticker paper. The sticker paper is coated with the following heat-sensitive color producing layers: a yellow layer, a magenta layer and a cyan layer. A heat-resistant protective layer is formed on the top of the layers.

The width of the paper 20 varies according to the size of sheets to be produced such as DIN size A4 (210 mm by 297 mm), A5 (148 mm by 210 mm), A6 (105 mm by 148 mm), etc. For example, the roll paper for A6 is 148 mm in width. In this embodiment, a description will be given of the roll paper for A6.

The sticker paper of the paper 20, which is only for producing the peel-off stickers, is cut previously in a fixed pattern in that substantially square sticker forms (predetermined forms) of 4×4 are arranged within the area of A6, while the backing paper is left uncut. The shape, number and arrangement of the stickers are not restricted to this.

The feed roller 24 is pressed towards the center of the roll of paper 20 by a pressing means (not illustrated) so that the feed roller 24 can contact with the outer circumference of the roll of paper 20. The feed roller 24 can be rotated by a rotational force of a motor (not illustrated) to transport the paper 20 to the right in FIG. 2.

The pinch roller 26 is rotatably attached on an end of a swingable arm 25 so as to face the capstan roller 28. The other end of the swingable arm 25 is drawn upwardly by a spring 29 and in contact with a cam member 27. When the cam member 27 is rotated by a rotational force of a motor (not illustrated), the arm 25 is swung and the pinch roller 26 is moved so that the pinch roller 26 and the capstan roller 28 can pinch and release the paper 20. After the feed roller 24 transports the paper 20 to the right in FIG. 2 and a home position sensor 46 detects that the leading end of the paper 20 has reached a position between the capstan roller 28 and the pinch roller 26, the pinch roller 26 is pressed against the capstan roller 28 and the paper 20 is pinched between the capstan roller 28 and the pinch roller 26.

The capstan roller 28 can be rotated by the motor in the same rotational directions as the feed roller 24 so that the paper 20 can reciprocate horizontally in FIG. 2 with the rotations of the feed roller 24 and the capstan roller 28.

The platen roller 32 is arranged at the opposite side of the thermal head 30 across the paper 20. The platen roller 32 is rotatably attached on an end of a swingable arm 31, of which the other end is drawn downwardly by a spring 35 and in contact with a cam member 33. When the cam member 33 is rotated by a rotational force of a motor (not illustrated), the arm 31 is swung and the platen roller 32 is moved so that the paper 20 can be pressed against and separated from the thermal head 30. When the paper 20 is transported to a predetermined position, the paper 20 is pressed against the thermal head 30 to start printing.

The cutter part 34 is arranged behind the thermal head 30. The cutter part 34 cuts the paper 20 to a sheet of a predetermined size (A6 for example) after the printing. Upper and lower edges of the cutter part 34 are arranged to face one another across the roll paper 20, and the upper and lower edges pinch and cut off the paper 20.

The photo-sensor 36 is arranged behind the cutter part 34. The photo-sensor 36 detects a printing reference mark (not illustrated) formed on the paper 20. One of a transmission-type photo-sensor and a reflection-type photo-sensor is used according to the mode of the printing reference mark. A jam sensor 48 is provided in proximity to the photo-sensor 34, and the jam sensor 48 detects the occurrence of the jam.

The M color fixing lamp 38 and the Y color fixing lamp 40 are arranged above the feeding paper 20. Paper ejecting pinch rollers 50 are provided between the M color fixing lamp 38 and the Y color fixing lamp 40 and behind the Y color fixing lamp 40. Paper ejecting driving rollers 42 are arranged at the opposite sides of the paper ejecting pinch rollers 50 across the paper 20.

As shown in FIG. 3, two pairs of the paper ejecting pinch rollers 50 and the paper ejecting driving rollers 42 are provided horizontally along the width of the paper 20 in FIG. 3, and the printing part 14 is provided with four pairs of the paper ejecting pinch rollers 50 and the paper ejecting driving rollers 42 altogether. Each paper ejecting pinch roller 50 is supported in such a way as to swing vertically in FIG. 3 through a lever member 52. Thus, the paper ejecting pinch roller 50 can be pressed against and separated from the paper ejecting driving rollers 42.

A motor (not illustrated) applies a rotational driving force to the paper ejecting rollers 42, and the paper ejecting rollers 42 rotate counterclockwise in FIG. 3 to transport a sheet of paper 20' that was cut to the predetermined size by the cutter part 34 onto the paper exit tray 56 at the left in FIG. 3. The paper exit tray 56 can be inserted into and extracted from a body of the printing part 14. The paper exit tray 56 is extracted from the body of the printing part 14 as the need arises during the printing, and is inserted into the body of the printing part 14 after it is used.

The printing part 14 performs the printing as described below. The paper 20 is transported to the right in FIG. 2 until the photo-sensor 36 detects the printing reference mark on the paper 20. Upon detecting, the capstan roller 28 and the pinch roller 26 transport the paper 20 to the left in FIG. 2 by a predetermined length to a printing start position. Then, the capstan roller 28 and the pinch roller 26 transport the paper 20 to the right at a constant speed, while the thermal head 30 is controlled to generate heat within a range of thermal energy with which the yellow layer on the paper 20 produces the yellow color so that the yellow layer can have a color density corresponding to the color image to be printed. Then, the Y color fixing lamp 40 throws a light of which central wavelength is 425 nm onto the paper 20 in order to fix the produced yellow color.

Then, the paper 20 is rewound to the printing start position, and it is transported to the right in FIG. 2 at a constant speed, while the thermal head 30 is controlled to generate heat within a range of thermal energy with which the magenta layer on the paper 20 produces the magenta color so that the magenta layer can have a color density corresponding to the color image to be printed. Then, the M color fixing lamp 38 throws a light of which central wavelength is 365 nm onto the paper 20 in order to fix the produced magenta color. Then, the paper 20 is rewound to the printing start position, and it is transported to the right in FIG. 2 at a constant speed, while the thermal head 30 is controlled to generate heat within a range of thermal energy with which the cyan layer on the roll paper 20 produces the cyan color so that the cyan layer can have a color density corresponding to the color image to be printed. The color image is thereby printed on the paper 20. The cutter part 34 cuts the paper 20 after the printing, and the paper ejecting driving rollers 42 and the paper ejecting pinch rollers 50 eject the sheet of paper 20', which is printed and cut, onto the paper exit tray 56.

A description will be given of the operation of the electronic picture print system, in which the printer constructed in the above-mentioned manner is included.

Figure 4:
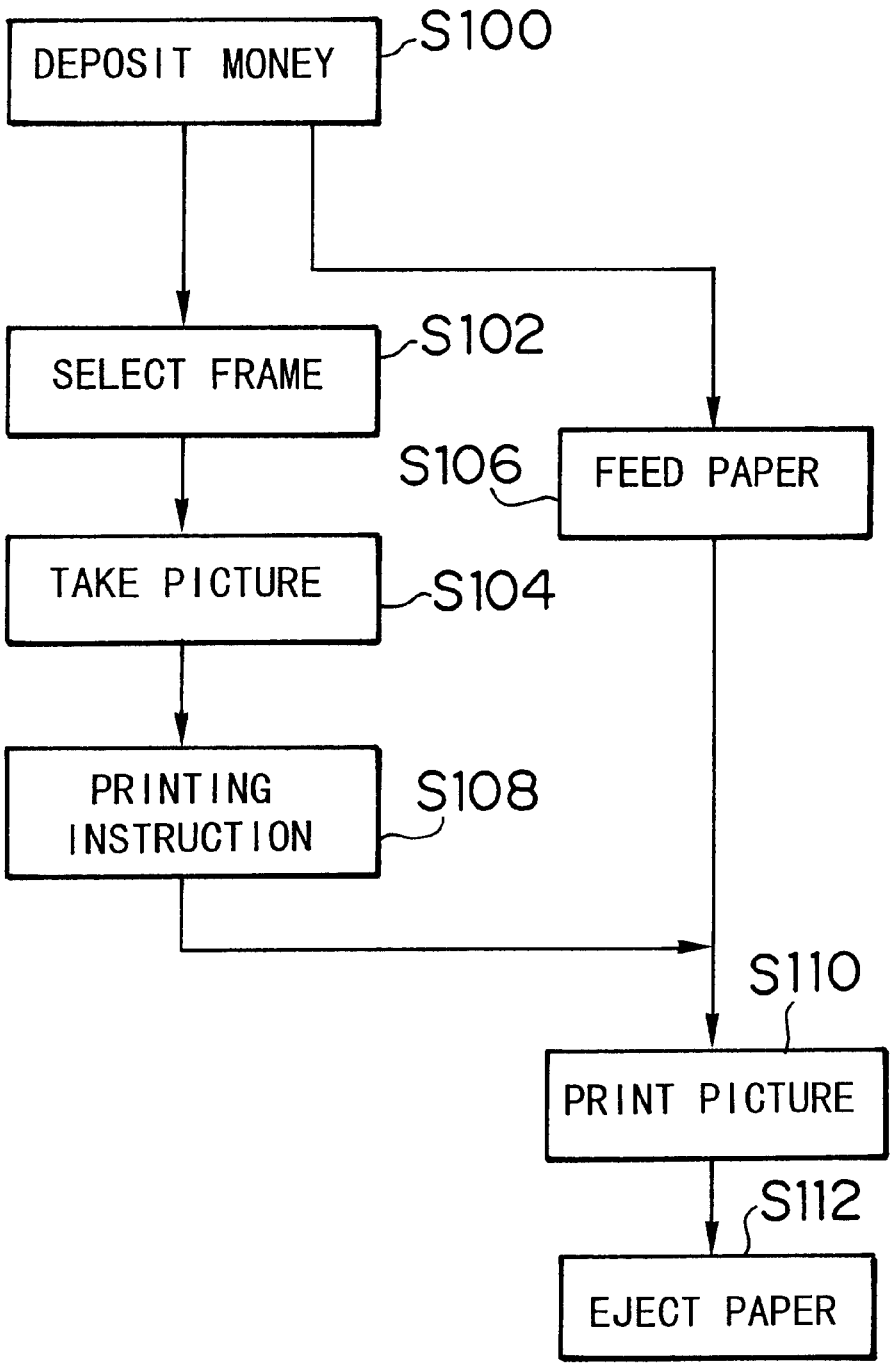
FIG. 4 is a flow chart showing the actions of the electronic picture print system in FIG. 1.

FIG. 4 shows the flow of the actions of the electronic picture print system according to the present invention. To use the electronic picture print system, the user deposits the money corresponding to the charge into the money receiver 16 (S100). After the deposit of the money, the user selects a desired frame (S102). Then, the user determines a picture composition, in which he or she is a subject, according to the selected frame, and takes a picture (S104).

During the above-mentioned processing, the printing part 14 feeds the paper 20 in the electronic picture print system 10. Specifically, when the money receiver 16 receives the money amounting the predetermined charge, the money receiver 16 outputs a preparation signal to the controller 18. Upon receiving the preparation signal, the controller 18 directs the printing part 14 to prepare the mechanism thereof to the standby state ready for the heating color-producing stage and feed the paper 20 (S106).

Upon the direction, the printing part 14 shifts the mechanism to the standby state ready for the heating stage at the thermal head 30 and feeds the paper 20 in order to prepare for printing. After the preparation is completed, the printing part 14 waits for the input of the printing instruction.

The user operates the control panel 17 to give instructions to select a frame, take a picture, cancel or determine the picture composition, and the like, and finally decides the picture composition to input the printing instruction (S108). In accordance with the instructions from the control panel 17, the system controller 18 takes a picture with the camera 12, and combines the subject image and the background frame. In response to the input of the printing instruction from the control panel 17, the system controller 18 sends the image data that is used for printing (the printing data) to the printing part 14 (S110).

Since the printing part 14 completes the preparations for printing before the input of the printing instruction, the printing part 14 performs the printing immediately upon receiving the printing data from the system controller 18, so that the picture including the subject image can be printed. After the printing, the paper 20 is cut in a predetermined size and is ejected (S112).

As stated above, the printing part 14 starts preparing for printing (the heating of the thermal head 30) upon the money deposited by the user amounting the predetermined charge. Thus, the preparations for printing can be performed while the user is selecting the frame, taking the picture, and the like. Hence, it is possible to reduce the time from the deposit of the money to the completion of the paper ejecting.

If the user directs the money receiver 16 to refund the deposited money prior to the input of the printing instruction at S108, the money receiver 16 refunds the deposited money, and the preparations for printing are stopped so that the printing part 14 can return automatically to the state before the deposit of the money.

If the waiting period is too long after the completion of the preparations for printing, the paper 20 may curl and the color-producing characteristics of the paper 20 may change in accordance with the exposure and changes in humidity and the like of the paper 20. It is therefore preferable to cancel the preparations for printing if a predetermined period (the waiting permissible time) has elapsed after the completion of the preparations.

To cancel the preparations for printing, a variety of ways can be adopted. For example, the paper 20 may be separated from the thermal head 30, the paper 20 may be rewound to the roll, and/or the paper 20 may be released from the transporting rollers, which are the pinch rollers 26 and the capstan rollers 28. The printing part 14 may be returned to the initial state before the deposit of the money. The way which is adopted is determined in view of the inconvenience resulting from the waiting for a long time, the restriction from the mechanism such as the paper transport system, the time required for reactivation, etc.

In order to protect the paper 20, the whole paper is preferably rewound into the roll paper storage part 22. If a precut sheet of paper is used, a complicated mechanism is required for restoring the sheet. For this reason, the sheet may be separated from the thermal head 30 and/or released from the transporting rollers, instead of restored.

A description will be given of the second embodiment of the present invention.

Figure 5:
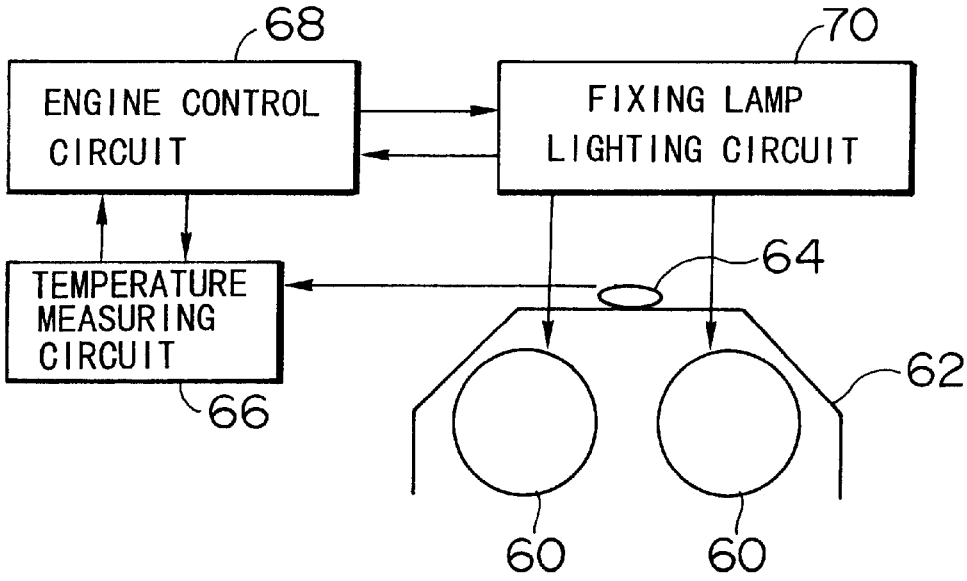
FIG. 5 is a view illustrating the structure of a fixing lamp part of a TA method printer according to the second embodiment of the present invention.

FIG. 5 shows the structure of a color fixing lamp part in the TA method printer according to the second embodiment of the present invention. As shown in FIG. 5, a temperature sensor 64 is provided on a reflective board 62, which covers tops of fixing lamps 60.

The temperature sensor 64 transmits a signal to a temperature measuring circuit 66, which sends temperature data to an engine control circuit 68. The engine control circuit 68 monitors and controls the actions of a printing mechanism of the printer (hereinafter referred to as a printing engine), and the engine control circuit 68 is included in the system controller 18 in FIG. 1. The engine control circuit 68 controls a fixing lamp lighting circuit 70 to turn on and off the fixing lamps 60 in accordance with the temperature data sent from the temperature measuring circuit 66.

A printer comprises the above-described structure is used as the printing part for the electronic picture print system described with reference to FIG. 1. While the user is selecting the frame and taking a picture after the deposit of the money, the fixing lamps 60 are pre-lighted.

Specifically, when the money receiver 16 receives the money amounting the predetermined charge, the money receiver 16 outputs the preparation signal to the controller 18. Upon receiving the preparation signal, the controller 18 reads the temperature data, which is obtained by the temperature sensor 64 provided in proximity to the fixing lamps 60, through the temperature measuring circuit 66. If the measured temperature is lower than a predetermined temperature, the system controller 18 directs the fixing lamp lighting circuit 70 to pre-light the fixing lamps 60.

The pre-lighting direction from the engine control circuit 68 (the system controller 18) is transmitted to the fixing lamp lighting circuit 70, which lights the fixing lamps 60 in accordance with the direction. While the fixing lamps 60 are pre-lighted, the temperature measuring circuit 66 always or regularly monitors the temperature by the temperature sensor 70. The fixing lamps 60 keeps lighted until the temperature around the fixing lamps 60 reaches the predetermined temperature.

When the temperature around the fixing lamps 60 reaches the predetermined temperature, the fixing lamps 60 are turned off. Then, if the temperature around the fixing lamps 60 becomes lower than the predetermined temperature after the fixing lamps 60 are turned off, the fixing lamps 60 may be turned on again. It is also possible to provide a timer for pre-lighting to turn off the fixing lamps 60 upon the passage of a predetermined time since the fixing lamps 60 are turned on.

There is a close relationship between the intensity of light emitted from the fixing lamp 60 and the peripheral temperature of the fixing lamp 60. Thus, in this embodiment, the temperature sensor 64 senses the temperature of the fixing lamp 60 and lights the fixing lamp 60 prior to the input of the printing instruction at the low temperature. This stabilizes the intensity of light emitted from the fixing lamp 60 quickly, and upon the input of the printing instruction, the printing is performed immediately. Consequently, the printing time seems to be reduced. This embodiment is particularly effective for the system in cold districts.

If the user directs to refund the deposited money prior to the input of the printing instruction, the pre-lighted fixing lamps 60 are turned off to automatically return to the state before the deposit of the money.

It is preferable to perform the pre-lighting of the fixing lamps 60 and the preparing for the printing described with reference to FIGS. 2–4, which includes the feeding of the paper, at the same time when the money is deposited.

In the above-described embodiments, the printer according to the present invention is incorporated into the electronic picture print system, but the present invention may also be applied to general printers that receive and print the data.

Figure 6:
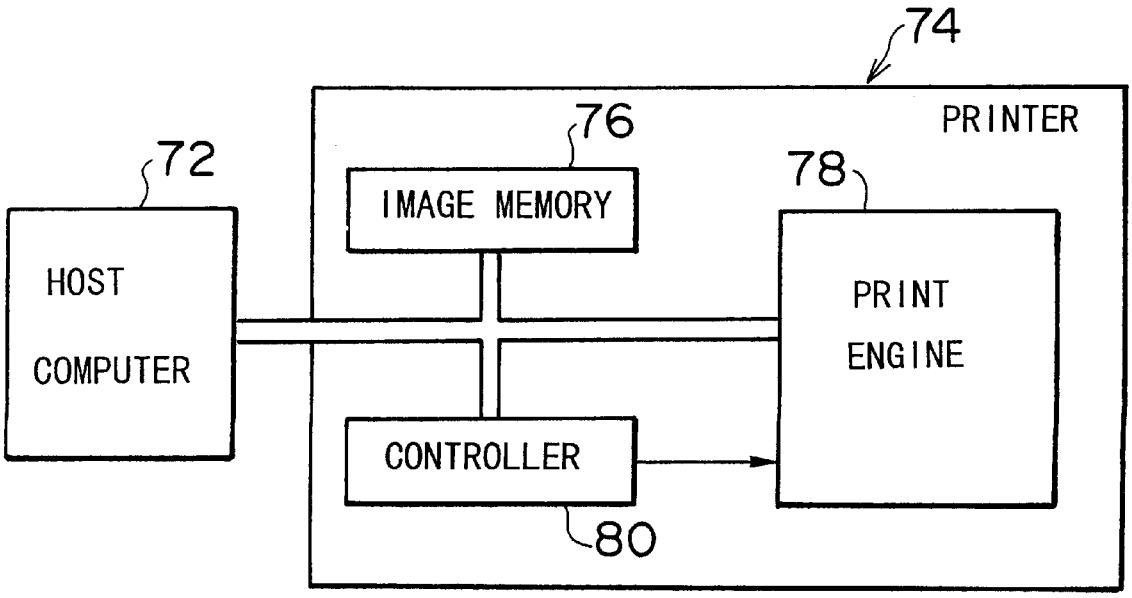
FIG. 6 is a view illustrating the structure of a print system according to the third embodiment of the present invention.

FIG. 6 shows the structure of a print system according to the third embodiment of the present invention. The print system comprises a personal computer as a host computer 72, and a printer 74 printing the image, which includes letters, actually in accordance with the instructions from the host computer 72.

The printer 74 comprises an image memory 76, a print engine 78 and a controller 80. The controller 80 manages and controls the operations of the print engine 78. The controller 80 also controls the input of the data into the image memory 76 and the output of the data from the image memory 76.

In the conventional system that comprises a printer and a personal computer, when the personal computer transfers the image data to the printer, the printer starts feeding the paper after the input of all the image data is completed and the printing is allowed. The printing starts after the feeding of the paper is completed, and the paper is ejected after the printing.

In this embodiment, the paper is fed and/or the fixing lamp is lighted before the host computer 72 starts transferring the image data or at the same time as the start of the transfer. Thus, the preparations for printing are performed during the transfer of the data. On completion of the preparations for printing, the system waits for the transfer of the data to be completed. If the input of all the image data is completed, the printing starts immediately. The paper is ejected after the printing.

A description will be given of the above procedure with reference to the flow chart of FIG. 7. When the controller 80 of the printer 74 receives a signal informing the start of the transfer of the data from the host computer 72, the controller 80 directs the print engine 78 to feed the paper (S204). In response to the instruction, the print engine 78 feeds the paper (S206) to a predetermined position.

While the paper is feeding, the host computer 72 transfers the printing data (S208). The received data is stored in the image memory 76 of the printer 74. Then, it is determined whether the transfer of all the data required for printing is completed or not (S210). If the transfer of the data is not completed, the transfer of the data continues. If the transfer of the data is completed, then it is determined whether the feeding of the paper is completed or not (S212).

Upon completion of the feeding of the paper that has been performed during the transfer of the data, the controller 80 instructs the print engine 78 to start printing (S214). In response to the instruction, the print engine 78 prints the image (S216) and ejects the printed paper for provision to the user (S218).

In this embodiment, the paper is feeding during the transfer of the image data prior to the input of the printing instruction. It is therefore possible to reduce the total period from the start of the transfer of the data until the completion of printing.

Figure 7:
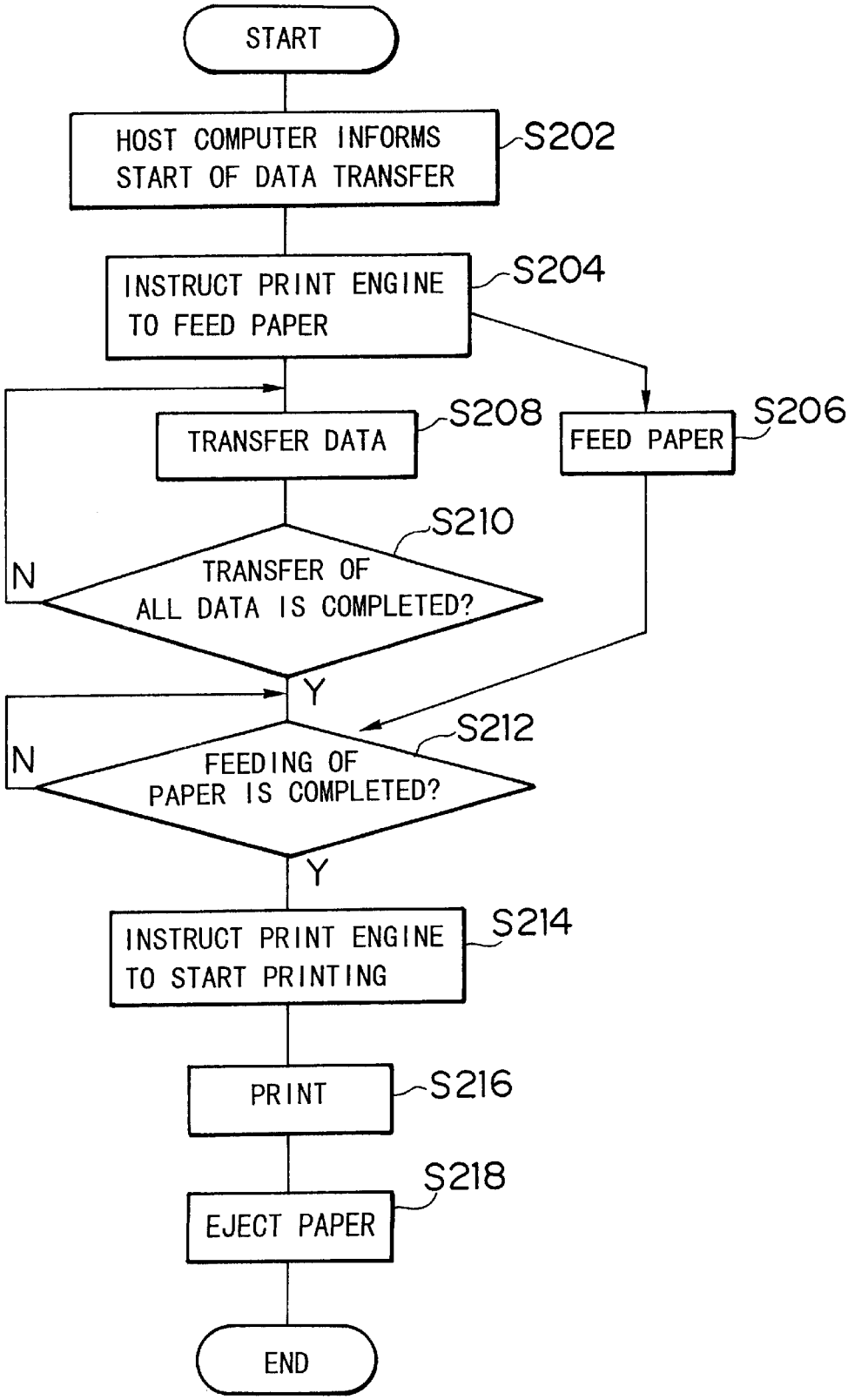
FIG. 7 is a flow chart showing the actions of the print system in FIG. 6.

In FIG. 7, the feeding of the paper is performed during the transfer of the data. The pre-lighting of the fixing lamp described with reference to FIG. 5 instead of the feeding of the paper may be performed during the transfer of the data. Both of the feeding of the paper and the pre-lighting of the fixing lamp may be performed during the transfer of the data.

In the above-described embodiments, the description was given of the TA printer, but the present invention may also be applied to a variety of printers such as bubble jetting, ink jetting and dot-impact printers, all of which achieves the same effects.

In the above-described embodiments, the roll paper for producing peel-off stickers is used, but the present invention may also be applied to a printer that uses normal recording paper and a printer that uses precut sheets of paper for producing peel-off stickers.

As set forth hereinabove, according to the printer of the present invention, the paper is fed and the fixing lamp is lighted to prepare for printing in accordance with the incoming control signal before or during the input of the printing data. When the input of the printing data is completed, the printing starts immediately in response to the printing instruction, and this reduces the printing time as a whole.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A printer comprising:

a paper storage part for storing paper;

a paper feeder for feeding the paper to a printing part from the paper storage part;

a printing data receiving part for receiving printing data representing an image to be printed;

the printing part for printing the image represented by the printing data on the paper fed by the paper feeder;

a controller for directing, upon receiving a preparatory signal, the paper feeder to prepare for the printing by transporting the paper to a printing preparation position before receiving of the printing data is completed, wherein the printing part feeds the printing paper to move the printing paper at a predetermined speed and simultaneously records the image data on the printing paper during feeding; and a money receiver for receiving deposited money, the money receiver counting the deposited money, the money receiver outputting the preparatory signal to the controller when the deposited money amounts to a predetermined charge.

2. The printer as defined in claim 1, further comprising a mechanism for moving the printing part between a standby state, and a retracted state where the printing is impossible; wherein the controller directs, upon receiving the preparatory signal, the shifting mechanism to prepare for the printing by shifting the printing part to the standby state before the receiving of the printing data is completed.

3. The printer as defined in claim 1, wherein:

the printing part comprises a thermal head for selectively heating the paper in a pattern corresponding to the image to be printed; and the printing preparation position of the paper and the standby state of the printing part are a position of the paper and a state of the printing part, respectively, ready for the thermal head to heat the paper.

4. A printer comprising:

a paper storage part for storing paper;

a paper feeder for feeding the paper to a printing part from the paper storage part;

a printing data receiving part for receiving printing data representing an image to be printed;

the printing part for printing the image represented by the printing data on the paper fed by the paper feeder;

a controller for directing, upon receiving a preparatory signal, the paper feeder to prepare for the printing by transporting the paper to a printing preparation position before the receiving of the printing data is completed; and a money receiver for receiving deposited money, the money receiver counting the deposited money, the money receiver outputting the preparatory signal to the controller when the deposited money amounts to a predetermined charge;

wherein if the money receiver is directed to refund the deposited money, the controller directs the paper feeder to cancel the preparation by restoring the paper from the printing preparation position to a state prior to the receiving of the preparatory signal.

5. A printer comprising:

a paper storage part for storing paper;

a paper feeder for feeding the paper to a printing part from the paper storage part;

a printing data receiving part for receiving printing data representing an image to be printed;

the printing part for printing the image represented by the printing data on the paper fed by the paper feeder;

a controller for directing, upon receiving a preparatory signal, the paper feeder to prepare for the printing by transporting the paper to a printing preparation position before the receiving of the printing data is completed;

a mechanism for shifting the printing part between a standby state, and a retracted state where the printing is impossible;

wherein the controller directs, upon receiving the preparatory signal, the shifting mechanism to prepare for the printing by shifting the printing part to the standby state before the receiving of the printing data is completed; and a money receiver for receiving deposited money, the money receiver counting the deposited money, the money receiver outputting the preparatory signal to the controller when the deposited money amounts to a predetermined charge;

wherein if the money receiver is directed to refund the deposited money, the controller directs the shifting mechanism to cancel the preparation by restoring the printing part from the standby state to the retracted state.

6. A printer comprising:

a paper storage part for storing paper;

a paper feeder for feeding the paper to a printing part from the paper storage part;

a printing data receiving part for receiving printing data representing an image to be printed;

the printing part for printing the image represented by the printing data on the paper fed by the paper feeder;

a controller for directing, upon receiving a preparatory signal, the paper feeder to prepare for the printing by transporting the paper to a printing preparation position before the receiving of the printing data is completed;

wherein the printing part comprises a thermal head for selectively heating the paper in a pattern corresponding to the image to be printed;

the printing preparation position of the paper and the standby state of the printing part are a position of the paper and a state of the printing part, respectively, ready for the thermal head to heat the paper; and a money receiver for receiving deposited money, the money receiver counting the deposited money, the money receiver outputting the preparatory signal to the controller when the deposited money amounts to a predetermined charge;

wherein if the money receiver is directed to refund the deposited money, the controller directs the paper feeder to cancel the preparation by restoring the paper from the printing preparation position to a state prior to the receiving of the preparatory signal.

7. A printer comprising:

a paper storage part for storing paper;

a paper feeder for feeding the paper to a printing part from the paper storage part;

a printing data receiving part for receiving printing data representing an image to be printed;

the printing part for printing the image represented by the printing data on the paper fed by the paper feeder; and a controller for directing, upon receiving a preparatory signal, the paper feeder to prepare for the printing by transporting the paper to a printing preparation position before the receiving of the printing data is completed;

wherein if a predetermined time has elapsed without a printing start instruction in the state where the paper is set at the printing preparation position, the controller directs the paper feeder to cancel the preparation by restoring the paper from the printing preparation position to a state prior to the receiving of the preparatory signal.

8. The printer as defined in claim 7, further comprising a money receiver for receiving deposited money, the money receiver counting the deposited money, the money receiver outputting the preparatory signal to the controller when the deposited money amounts to a predetermined charge.

9. The printer as defined in claim 8, wherein if the money receiver is directed to refund the deposited money, the controller directs the paper feeder to cancel the preparation by restoring the paper from the printing preparation position to a state prior to the receiving of the preparatory signal.

10. A printer comprising:

a paper storage part for storing paper;

a paper feeder for feeding the paper to a printing part from the paper storage part;

a printing data receiving part for receiving printing data representing an image to be printed;

the printing part for printing the image represented by the printing data on the paper fed by the paper feeder; and a controller for directing, upon receiving a preparatory signal, the paper feeder to prepare for the printing by transporting the paper to a printing preparation position before the receiving of the printing data is completed;

wherein the paper feeder comprises a pinch roller and a capstan roller for pinching the paper to feed; and wherein if a predetermined time has elapsed without a printing start instruction in a state where the paper is set at the printing preparation position, the controller directs the paper feeder to make the pinch roller and the capstan roller release the paper.

11. The printer as defined in claim 10, further comprising a money receiver for receiving deposited money, the money receiver counting the deposited money, the money receiver outputting the preparatory signal to the controller when the deposited money amounts to a predetermined charge.

12. The printer as defined in claim 11, wherein if the money receiver is directed to refund the deposited money, the controller directs the paper feeder to make the pinch roller and the capstan roller release the paper.

13. A printer comprising:

a paper storage part for storing heat-sensitive paper comprising a base and a color producing layer formed on the base;

a paper feeder for feeding the paper to a printing part from the paper storage part;

a printing data receiving part for receiving printing data representing an image to be printed;

the printing part for printing the image represented by the printing data on the paper fed by the paper feeder, the printing part comprising a thermal head for selectively heating the paper in a pattern corresponding to the image to be printed such that the color producing layer produces a color;

a fixing lamp for throwing a light of a predetermined wavelength onto the paper to stop an action of the color producing layer after the thermal head heats and activates the color producing layer;

a controller for pre-lighting the fixing lamp upon receiving a preparatory signal before the receiving of the printing data is completed; and a money receiver for receiving deposited money, the money receiver counting the deposited money, the money receiver outputting the preparatory signal to the controller when the deposited money amounts to a predetermined charge.

14. The printer as defined in claim 13, further comprising a temperature measuring part for measuring a temperature around the fixing lamp; wherein the controller stops the pre-lighting of the fixing lamp if the temperature measured by the temperature measuring part is higher than a predetermined temperature.

15. A printer comprising:

a paper storage part for storing heat-sensitive paper comprising a base and a color producing layer formed on the base;

a paper feeder for feeding the paper to a printing part from the paper storage part;

a printing data receiving part for receiving printing data representing an image to be printed;

the printing part for printing the image represented by the printing data on the paper fed by the paper feeder; the printing part comprising a thermal head for selectively heating the paper in a pattern corresponding to the image to be printed such that the color producing layer produces a color;

a fixing lamp for throwing a light of a predetermined wavelength onto the paper to stop an action of the color producing layer after the thermal head heats and activates the color producing layer; and a controller for pre-lighting the fixing lamp upon receiving a preparatory signal before the receiving of the printing data is completed;

a money receiver for receiving deposited money, the money receiver counting the deposited money, the money receiver outputting the preparatory signal to the controller when the deposited money amounts to a predetermined charge;

wherein if the money receiver is directed to refund the deposited money, the controller stops the pre-lighting of the fixing lamp.

16. A printer comprising:

a paper storage part for storing heat-sensitive paper comprising a base and a color producing layer formed on the base;

a paper feeder for feeding the paper to a printing part from the paper storage part;

a printing data receiving part for receiving printing data representing an image to be printed;

the printing part for printing the image represented by the printing data on the paper fed by the paper feeder; the printing part comprising a thermal head for selectively heating the paper in a pattern corresponding to the image to be printed such that the color producing layer produces a color;

a fixing lamp for throwing a light of a predetermined wavelength onto the paper to stop an action of the color producing layer after the thermal head heats and activates the color producing layer;

a controller for pre-lighting the fixing lamp upon receiving a preparatory signal before the receiving of the printing data is completed;

a temperature measuring part for measuring a temperature around the fixing lamp;

wherein the controller stops the pre-lighting of the fixing lamp if the temperature measured by the temperature measuring part is higher than a predetermined temperature; and a money receiver for receiving deposited money, the money receiver counting the deposited money, the money receiver outputting the preparatory signal to the controller when the deposited money amounts to a predetermined charge;

wherein if the money receiver is directed to refund the deposited money, the controller stops the pre-lighting of the fixing lamp.

17. A printer comprising:

a paper storage part for storing heat-sensitive paper comprising a base and a color producing layer formed on the base;

a paper feeder for feeding the paper to a printing part from the paper storage part;

a printing data receiving part for receiving printing data representing an image to be printed;

the printing part for printing the image represented by the printing data on the paper fed by the paper feeder, the printing part comprising a thermal head for selectively heating the paper in a pattern corresponding to the image to be printed such that the color producing layer produces a color;

a fixing lamp for throwing a light of a predetermined wavelength onto the paper to stop an action of the color producing layer after the thermal head heats and activates the color producing layer;

a controller for pre-lighting the fixing lamp upon receiving a preparatory signal before the receiving of the printing data is completed; and a money receiver for receiving deposited money, the money receiver outputting the preparatory signal to the controller to pre-light the fixing lamp at a same time as said paper feeder prepares for printing by transporting the paper to a printing preparation position before receipt of the printing data is completed.

* * * * *